US006802869B2

(12) United States Patent
Kim et al.

(10) Patent No.: US 6,802,869 B2
(45) Date of Patent: Oct. 12, 2004

(54) CELLULOSIC MATERIALS HAVING COMPOSITE CRYSTALLINE STRUCTURE

(75) Inventors: Ik Soo Kim, Suwon-si (KR); Jong Soo An, Seoul (KR); Byung Hak Kim, Suwon-si (KR)

(73) Assignee: SK Chemicals Co., Ltd., Suwon-si (KR)

( * ) Notice: Subject to any disclaimer, the term of this patent is extended or adjusted under 35 U.S.C. 154(b) by 380 days.

(21) Appl. No.: 10/042,243

(22) Filed: Jan. 11, 2002

(65) Prior Publication Data

US 2002/0098355 A1 Jul. 25, 2002

Related U.S. Application Data

(62) Division of application No. 09/706,721, filed on Nov. 7, 2000, now Pat. No. 6,361,862.

(30) Foreign Application Priority Data

Mar. 27, 2000 (KR) ..... 2000-15443

(51) Int. Cl.[7] ..... D06M 0/00; D06M 11/00; D06M 13/00; D06M 23/00

(52) U.S. Cl. ..... 8/115.51; 8/116.1; 428/393

(58) Field of Search ..... 8/115.1, 116.1; 428/393

(56) References Cited

U.S. PATENT DOCUMENTS 4,871,370 A 10/1989 Yatsu et al.
5,322,524 A 6/1994 Yatsu et al.
6,361,862 B1 * 3/2002 Kim et al. ..... 428/393

OTHER PUBLICATIONS

Dictionary of Fiber & Textile Technology, p. 127, Dale 1990.
Morrison and Boyd, Organic Chemistry, 5$^{th}$ edition, p. 1279.
Morrison and Boyd, Organic Chemistry, 5$^{th}$ edition, p. 1312–1314.
"Handbook fo Fiber Science and Technology: vol. IV", "Fiber Chemistry", pp. 968–977.
"Formation and Characteristics of the Crystalline Cellulose x Modification of Cellulose", J. Polymer Sci., 58, pp. 769–779 (1962).
"Quantitative Investigation of the X–Ray Diffraction Picture of Some Typical Rayon Specimens, Part I", Textile Research Journal, pp. 558–571, Jun. 1961.
"Packing analysis of Carbohydrates and Polysaccharides. 16. The crystal structures of celluloses $IV_I$ and $IV_{II}$", Can J. Chem., 63, p. 173–180 (1985).
"The Confirmation of Cellulose $III_I$, $III_{II}$, and $IV_{II}$ by the X–Ray Method", Polymer Letters Edition, 13, p. 23–27 (1975).

* cited by examiner

*Primary Examiner*—Yogendra N. Gupta
*Assistant Examiner*—D. G. Hamlin
(74) *Attorney, Agent, or Firm*—McGuireWoods LLP

(57) ABSTRACT

Disclosed is a novel rayon fiber which possesses characteristics similar to those of a viscose rayon fiber as to be suitable for use in clothes in addition to being produced at an economical cost. The rayon fiber is prepared from a cellulose acetate fiber with a degree of substitution of 2.0 or higher by saponifying 75% or greater of the total acetyl groups of the cellulose acetate fiber into hydroxyl groups and has a composite crystalline structure of cellulose II and IV.

30 Claims, 1 Drawing Sheet

CELLULOSIC MATERIALS HAVING COMPOSITE CRYSTALLINE STRUCTURE

CROSS-REFERENCE TO RELATED APPLICATIONS

This application is a divisional application of application Ser. No. 09/706,721, filed on Nov. 7, 2000, now U.S. Pat. No. 6,361,862.

BACKGROUND OF THE INVENTION

1. Field of the Invention

The present invention relates to a novel rayon fiber which possesses characteristics similar to those of a viscose rayon fiber as to be suitable for use in clothes in addition to being produced at economical cost. Also, the present invention is concerned with a method for producing such a rayon fiber. As used herein, the term "rayon fiber" is defined as a fiber made of a polymer of β-D-glucopyranose (hereinafter referred to as "cellulose") in which not more than 15% of the hydroxyl groups have been substituted.

2. Description of the Prior Art

Rayon fibers are used for high quality clothes by virtue of their characteristic gloss, specific gravity, and good sense to the touch. Usually, viscose rayon (hereinafter referred to as "rayon") fibers are made by spinning, in an aqueous solution of sulfuric acid and zinc sulfate, an aqueous sodium cellulose xanthate solution which is prepared by dissolving cellulose in a caustic soda solution using carbon disulfide ($CS_2$). However, to produce viscose rayon fibers is very difficult. For example, during the production of viscose rayon fibers, highly toxic materials, such as carbon disulfide, are generated. In addition, since a dyeing difference is apt to occur between an inner and an outer layer even in the same pirn, fiber products of uniform color are very difficult to produce.

Lyocell fibers, which are spun from a solution of cellulose in N-methylmorpholine-N-oxide, have not been processed into textile products owing to their excessive stiffness and expensive cost until a recent success of enzymatic processing. Fortisan, a high tenacity viscose rayon manufactured by Celanese, is prepared by drawing cellulose acetate and saponifying the drawn cellulose acetate with alkali. With a tenacity as high as 7 gf/de and an elongation as low as 8%, Fortisan can find numerous applications in the industrial fiber industry, including tire cords, conveyor belts, fire hoses and so on.

Methods for preparing rayon from cellulose acetate can be found in Robert, W. Work, TEXTILE Research Journal, Vol. XIX, No. 7, pp 381–393, July, 1949, which is responsible for the production of Forthisan and to U.S. Pat. No. 2,053,766 which discloses a high tenacity rayon yarn (tenacity 2.5 gf/de or higher). According to the references, spun acetate fibers are drawn and saponified with alkali to produce rayon fibers having a cellulose II crystalline structure. Their high tenacity and poor elongation restrict the rayon fibers to industrial uses. Even so, they are not produced owing to high cost.

SUMMARY OF THE INVENTION

Therefore, it is an object of the present invention to provide a rayon fiber which is similar in characteristics to a viscose rayon fiber, suitable for use in clothes and producible at economical cost.

It is another object of the present invention to provide a method for producing such a rayon fiber with ease.

It is a further object of the present invention to provide cloth products using such a rayon fiber, including woven, knitted fabric, and non-woven fabrics.

In accordance with a first embodiment of the present invention, there is provided a rayon fiber, possessing a composite crystalline structure of cellulose II and IV, which is prepared by saponifying at least 75% of the total acetyl groups of a cellulose acetate fiber with a degree of substitution of at least 2.0 into hydroxyl groups.

In accordance with a second embodiment of the present invention, there is provided a method for preparing a rayon fiber, comprising the step of treating a cellulose acetate fiber with a strong alkali alone or with a strong and a weak alkali in the same bath or different baths to saponify at least 75% of the total acetyl groups of the cellulose acetate fiber into hydroxyl groups, said cellulose acetate fiber having a degree of substitution of 2.0 or higher, whereby the rayon fiber has a composite crystalline structure of cellulose II and IV.

In accordance with a third embodiment of the present invention, there is provided a method for preparing a rayon fiber, comprising the step of treating a fiber material comprising cellulose acetate fibers alone or in combination with other fibers with a strong alkali alone or with a strong and a weak alkali in the same bath or different baths to saponify at least 75% of the total acetyl groups of the cellulose acetate fibers into hydroxyl groups, said fiber material being selected from a woven fabric, knitted fabric and a non-woven fabric, which are made by weaving, knitting or niddle punching cellulose acetate fibers alone or in combination with other fibers, said cellulose acetate fibers having a degree of substitution of 2.0 or higher, whereby the rayon fiber has a composite crystalline structure of cellulose II and IV.

In accordance with a fourth embodiment of the present invention, there is provided a method for producing a rayon film, comprising the step of treating a cellulose acetate film with a strong alkali alone or with a strong and a weak alkali in the same bath or different baths to saponify at least 75% of the total acetyl groups of the cellulose acetate film into hydroxyl groups, said cellulose acetate film having a degree of substitution of 2.0 or higher, whereby the rayon film has a composite crystalline structure of cellulose II and IV.

In accordance with a fifth embodiment of the present invention there is provided a rayon fiber product, comprising a rayon fiber which possesses a composite crystalline structure of cellulose II and IV and is prepared by saponifying at least 75% of the total acetyl groups of a cellulose acetate fiber with a degree of substitution of 2.0 or higher into hydroxyl groups.

In accordance with a sixth embodiment of the present invention, there is provided a rayon film, which is prepared from a cellulose acetate film with a degree of substitution of 2.0 or higher by saponifying at least 75% of the total acetyl groups of the film into hydroxyl groups and possesses a composite crystalline structure of cellulose II and IV.

BRIEF DESCRIPTION OF THE INVENTION

DETAILED DESCRIPTION OF THE INVENTION

Figure 1:
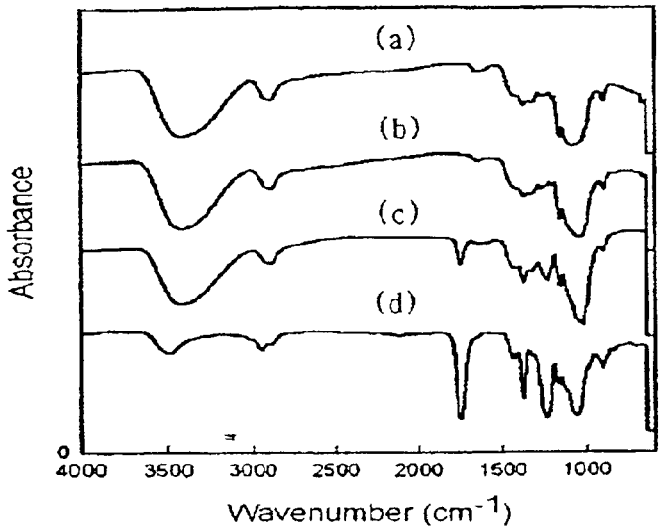
FIG. 1 shows IR spectra for a viscose rayon fiber (a), a rayon fiber with a weight loss of 40.1% (b), a rayon fiber with a weight loss of 33.7% (c), and a cellulose acetate fiber which was not allowed to undergo weight loss (d).

Before the present cellulose acetate rayon fiber is disclosed or described, it is to be understood that the terminology used therein is for the purpose of describing particular embodiments only and is not intended to be limiting. It must be noted that, as used in the specification and the appended claims, the singular forms "a", "an" and "the" include plural referents unless the context clearly dictate otherwise.

Throughout this application, where publications are referenced, the disclosures of these publications in their entireties are hereby incorporated by reference into this application in order to more fully describe the state of the art to which this invention pertains.

The present invention contemplates a rayon fiber which is featured in that a cellulose acetate fiber with a degree of substitution of 2.0 (combined acetic acid 45%) or greater is saponified at 75% or greater of its total acetyl groups into hydroxyl groups and shows a composite crystalline structure of cellulose II and cellulose IV.

Conventional rayon fibers, such as viscose rayon, cupra ammonium rayon, Bemberg rayon, high tenacity rayon, and Fortisan, have a crystalline structure of cellulose II in the crystalline region (see: P. H. Hermans, Makromolecules, Chem., Vol. 6, pp 25–29; J. Dyer and G. C. Daul, Handbook of Fiber Science and Technology, Vol. IV; edited by M. Lewin and E. M. Pearce; Fiber Chemistry, p 968, Marcel Dekker 1985). In contrast, the rayon fiber of the present invention shows a cellulose II and a cellulose IV crystalline structure together at the crystalline region.

For rayon, 75% or greater of the total acetyl groups of cellulose acetate must be saponified into hydroxy; otherwise, it is not defined as rayon.

Compared with a cellulose acetate fiber, that is, its source, the rayon fiber of the present invention has an increased breaking strength, similar or higher breaking elongation, and a decreased birefringence, but increased in crystallinity, specific gravity and moisture regain.

As measured by a specific gravity method, the rayon fiber of the present invention is found to range, in crystallinity, from 14 to 34% and, in birefringence, from 0.012 to 0.024. In specific gravity, the rayon fiber of the present invention is increased to 1.48–1.51 gm/cm$^3$, similar to that of a viscose rayon fiber and higher than that of a cellulose acetate fiber, which is in the range of 1.32 (cellulose diacetate)—1.33 gm/cm$^3$ (cellulose triacetate).

While the material cellulose acetate fiber is on the order of 1.2–1.4 gf/de in breaking strength and 20–40% in breaking elongation, the rayon fiber of the present invention shows a breaking strength of 1.2–2.5 gf/de and a breaking elongation of 20–50%. The breaking strength and breaking elongation of the rayon fiber of the present invention are found to be similar to those of preexisting viscose rayon.

Therefore, since the rayon fiber of the present invention is similar to preexisting viscose rayon in mechanical properties, such as strength and elongation, in physical properties, such as gravity, crystallinity and orientation degree, in dissolution property against organic solvent, and in moisture regain, the rayon fiber of the present invention can be applied for the same uses of the preexisting viscose rayon.

In addition to being dyed with textile dyes for cellulose fibers, such as direct dye, reactive dye, vat dye, naphthol dye, and sulphur dye, the rayon fiber of the present invention shows superb dyeing properties as high as those of mercerized cotton or viscose rayon.

Whereas not being dissolved in organic solvents for acetate, such as dichloromethane, dimethylformamide, dimethylsulfoxide and acetone, the rayon fiber of the present invention is dissolved in organic solvent for cellulose, such as N-methylmorpholin-N-oxide, lithium chloride/dimethylacetamide, and cadoxene.

Material suitable for the rayon fiber of the present invention are cellulose acetate fibers which have a degree of substitution of 2.0 (combined acetic acid 45%) or greater and preferably a degree of substitution of 2.0–3.0 (combined acetic acid 45–62.5%). For example, a diacetate fiber with a degree of substitution from 2.0 to 2.75 (combined acetic acid 45 to 59.5%), a triacetate fiber with a degree of substitution of 2.75 or greater (combined acetic acid 59.5% or greater), or a mixture thereof may be used.

Below, a detailed description will be given of the preparation of the rayon fiber of the present invention with reference to various examples, which is set forth to illustrate, but not limit the present invention.

The rayon fiber of the present invention can be prepared through a saponification process in which an appropriate cellulose acetate fiber is treated with a strong alkali alone and with a strong and a weak alkali in a same bath manner or a different bath manner. For the preparation of the rayon fiber, woven fabrics, knitted fabrics or non-woven fabrics made by weaving or knitting cellulose acetate fibers alone or in combination with other fibers may be subject to a saponification process comprising treatment with a strong alkali alone and with a strong and a weak alkali in a same bath or different baths. Alternatively, a cellulose acetate film may be used as a material for the rayon film of the present invention. That is, a cellulose acetate film is saponified by being treated with a strong alkali alone or a strong and a weak alkali in the same bath or in different baths.

In the saponification process of cellulose acetate, a quaternary ammonium salt or a phosphonium salt may be used along with alkali. The saponification process is preferably conducted at 80° C.

Examples of available alkali compounds in the saponification process include strong alkali compounds, which includes metal hydroxides such as sodium hydroxide and alkaline earth metal hydroxides such as calcium hydroxide, and weak alkali compounds which includes metal salts such as sodium carbonate. Such an alkali compound may be used alone or in combination with a saponification accelerators. A commercially available saponification accelerator is exemplified by NEORATE NCB (Korea Fine Chemicals Co. Ltd.) as a phosphonium salt prompter; and KF NEORATE NA-40 (Korea Fine Chemicals Co. Ltd.), DYK-1125 and DXY-10N (Iposya), CASERIN PES, CASERIN PEL and CASERIN PEF (Meisei Kagaku Co. Ltd.) and SNOGEN PDS (Daeyoung Chemicals Co. Ltd) as quaternary ammonium salt accelerators.

For the saponification process, an alkali is dissolved at an amount of 10–60% by weight based on the total weight of cellulose acetate in water. The saponification can be achieved by immersing cellulose acetate in the aqueous alkaline solution at 70–130° C. and preferably at 80° C. This saponification procedure is preferably, but not limitatively, conducted for 1–60 min once or twice in the aqueous alkaline solution.

There exists a cellulose IV crystalline structure in the crystalline region of the rayon fiber of the present invention. In order to construct a cellulose IV crystalline structure, conventionally, cellulose II and III crystals are treated at 250–290° C. in glycerine.

During the saponification process of cellulose acetate fibers in accordance with the present invention, molecular chains of cellulose acetate, in which an amorphous region prevails, are altered into those of cellulose while the molecular chains undergo the rearrangement of folding and packing so as for crystallization to occur. In this course, the birefringence, which indicates the orientation degree of the molecular chain, is lowered with a prevalence of a crystal region.

The method of producing a rayon fiber in which a cellulose II crystalline structure coexists with a cellulose IV crystalline structure, in accordance with the present invention, enjoys advantages of being very simple and low in production cost. Unlike conventional production methods of viscose rayon which use highly concentrated alkali solutions, carbon disulfide and sulfuric acid, the method according to the present invention does not produce serious pollutants, and is not a complicated process. The method of the present invention can employ various cellulose acetate fibers or products to produce rayon in an environment-friendly and simple process.

In addition, the object of the present invention is true for films. In accordance with the present invention, a rayon film is prepared from a cellulose acetate film with a degree of substitution of 2.0 or higher by saponifying 75% or greater of the total acetyl groups of the cellulose acetate film into hydroxyl groups. Like the rayon fiber, the rayon film of the present invention has a composite crystalline structure of cellulose II and IV. The rayon film can be prepared in a similar manner to that for the rayon fiber. For instance, a cellulose acetate with a substitution of 2.0 or higher is treated with a strong alkali alone or with a strong alkali and a weak alkali in a same bath or different baths to saponify 75% or greater of the total acetyl groups of the cellulose acetate into hydroxyl groups and produce a composite crystalline structure of cellulose II and IV.

A better understanding of the present invention may be obtained in light of the following examples which are set forth to illustrate, but are not to be construed to limit the present invention.

In the following examples, various parameters are measured as follows.

Weight loss: a sample was measured for its weight change before and after an alkali treatment and calculated through the following equation:

$$\text{Weight Loss (\%)} = \frac{\text{Sample Wt. Before Treatment} - \text{Sample Wt. After Treatment}}{\text{Sample Wt. Before Treatment}} \times 100$$

Deacetylation: identified by IR spectroscopic analysis using an IR spectrophotometer, such as that manufactured by Nicolet, USA, identified as MAGNA 750. For its quantitative determination, the C-O stretching peak of β-D-glucopyranose, which was read at 1160 $cm^{-1}$, and the carbonyl band of acetyl groups, which was read at 1760 $cm^{-1}$, were calculated by integration and the ratio between them was obtained.

Crystalline Structure: identified using a CuKα line filtered through a nickel filter with the aid of an X-ray diffractometer, such as that manufactured by Mac Science, Japan, identified as M18XHF, Crystallinity: determined from densities measured by use of a density gradient column, through the following equation:

$$\text{Crystallinity (\%)} = \frac{\rho - \rho_a}{\rho_C - \rho_a} \times 100$$

wherein, ρ is a density of a sample, $\rho_c$ is a density of a crystalline region (1.615), and $\rho_a$ is a density of an amorphous region (1.436).

Breaking Strength and Breaking Elongation of Fiber: measured by a universal testing machine (ZWICK 1425) while a sample 50 mm long was stretched at a tension speed of 200 mm/min.

Birefringence of Fiber (□n): calculated from the refractive indexes of polarized lights which vibrated in the directions perpendicular and parallel to the axis of a fiber, respectively, were measured with the aid of a polarized microscope, such as that manufactured by Leitz, Germany, identified as VRRIO ORTHOMAT-II.

Moisture Regain of Fiber: measured according to the KS-K 0220 oven method.

Dyeing Property: a sample was dyed at 90° C. for 30 min with a 1% o.w.f concentration of C. I. Direct Blue 200 (Nippon Kayaku; Kayarus Supra Blue 4BL), followed by soaping and rinsing at 70° C. in an ordinary process. The dyed sample was measured for reflectance by use of a spectrophotometer, such as that manufactured by Macbeth USA, identified as Color-Eye 7000A). From the reflectance obtained, the color strength of the dyeing was determined through the following equation $$K/S=(1-R)^2/2R$$

PREPARATION EXAMPLE I 75 d/20 f cellulose diacetate fibers with a degree of substitution of 2.55 (combined acetic acid 56.9%) was scoured and dried. Separately, water was poured into a dyeing machine and added with caustic soda at an amount of 31.3–40% by weight based on the weight of the cellulose diacetate fibers. After being immersed in the aqueous caustic solution, the degummed and dried diacetate fibers were heated at a rate of 2° C./min from 30° C. to 98° C., then treated for 30 min at the dyeing temperature, and cooled at a rate of 2° C./min to 30° C., followed by the drainage of the liquid. In the dyeing machine, the fibers were washed with water at room temperature to remove residual alkali and then dried. In this regard, saponification conditions and percent weight loss are summarized in Table 1, below. As listed in Table 1, the final weights of the fibers were reduced at a weight loss of 34–40% compared with the initial ones.

The deacetylation of the fibers was identified through IR spectra and the spectral results are given as shown in FIG. 1. In the spectral diagram, curve a is responsible for the 75 d/24 f viscose rayon manufactured by Cherkassy, Ukraine, serving as a control. The diacetate fiber used as a raw material contains a large quantity of carbonyl groups which produced the large peak at 1760 $cm^{-1}$. In contrast, the carbonyl peak at 1760 $cm^{-1}$ was greatly reduced in the rayon fiber which showed a weight loss of 34% as a result of the saponification treatment. Further, in the rayon fiber which had a weight loss of 40%, the carbonyl peaks completely disappeared. On the other hand, the hydroxy stretching peak at 3400 $cm^{-1}$ intensified with increasing weight loss. Curve (b) shows the same spectral pattern as the curve (a) as almost all of the acetyl groups are substituted with hydroxyl groups.

Figure 2:
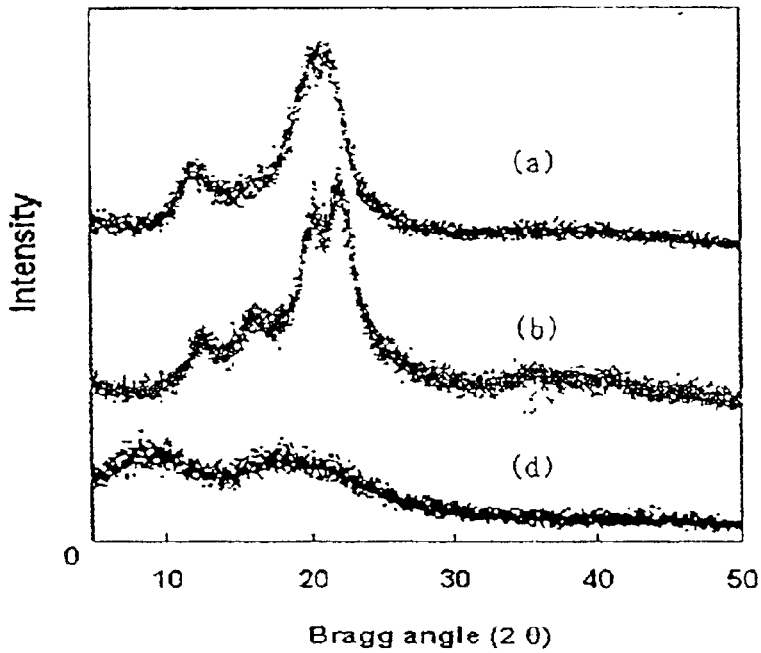
FIG. 2 shows X-ray diffraction spectra for a viscose rayon fiber (a), a rayon fiber with a weight loss of 40.1% (b), a rayon fiber with a weight loss of 33.7% (c), and a cellulose acetate fiber which was not allowed to undergo weight loss (d).

With reference to FIG. 2, there are shown X-ray diffraction spectra of the fibers prepared above. For comparison, a 75 d/24 f viscose rayon fiber manufactured by Cherkassy was used as a control and its X-ray diffraction spectrum is given as curve (a). Analysis of crystalline structures from the X-ray spectra was referred to Φ. Ellefsen, J. Polymer Science Vol. 58, pp 769–779, 1962. No developed crystal components are detected in the cellulose disacetate, curve (d), which was not reduced in weight. The control fiber shows a crystalline structure of cellulose II. On the other hand, the rayon fiber curve (b), which was reduced to the weight loss of 40.1% shows a crystalline structure of cellulose II as Bragg angles (2θ) appear at 12.4°, 22.2° and 40.7°, as well as a very developed crystalline structure of cellulose IV as great Bragg angles (2θ) appear at 16.1°, 20.7°, 28.3° and 36.5°. Therefore, the rayon fiber of curve (b) has a composite crystalline structure of cellulose II and IV.

Physical properties of the fibers obtained are summarized in Table 2, below. Sample A-1, which did not experience the weight loss treatment, shows physical properties of characteristics of cellulose diacetate. On the other hand, a gradual increase in breaking strength and a closer approach to a rayon fiber in gravity, orientation degree, moisture regain, and dyeing property with a direct dye were detected going from sample A-2 which showed a weight loss of 33.7% (combined acetic acid 12.3%) to sample A-6 which was completely deacetylated.

TABLE 1

| Samples | Saponification Conditions & Weight Loss of Cellulose Diacetate Fibers | |
|---|---|---|
| | Amount of NaOH (%) | Weight Loss (%) |
| A-1 | 0 | 0 |
| A-2 | 31.3 | 33.7 |
| A-3 | 32.5 | 35.1 |
| A-4 | 34.8 | 37.5 |
| A-5 | 36.5 | 39.3 |
| A-6 | 40.0 | 40.1 |

TABLE 2

| Samples | Physical Properties of Cellulose Diacetate Fibers | | | | | | |
|---|---|---|---|---|---|---|---|
| | De | Breaking Strength (gf/de) | Breaking Elong. (%) | Specific Gravity (gm/cm$^3$) | Moisture Regain (%) | Δ n (×10$^3$) | K/S Values |
| A-1 | 75.0 | 0.68 | 35.6 | 1.3100 | 6.5 | 25.5 | 0.06 |
| A-2 | 54.0 | 1.25 | 30.2 | 1.4712 | 10.5 | 12.8 | 9.32 |
| A-3 | 53.2 | 1.28 | 33.5 | 1.4941 | 10.9 | 13.3 | 10.42 |
| A-4 | 52.5 | 1.30 | 36.2 | 1.4949 | 11.2 | 13.9 | 11.50 |
| A-5 | 52.7 | 1.40 | 36.1 | 1.4951 | 12.1 | 14.2 | 12.20 |
| A-6 | 52.9 | 1.50 | 36.4 | 1.4952 | 12.4 | 14.0 | 12.30 |

PREPARATION EXAMPLE II

After being scoured and dried, a plain fabric (warp 75 d/20 f, weft SB 120 d/33 f, weft density 67 yarns/inch) consisting of triacetate fiber with a degree of substitution of 2.92 (combined acetic acid 61.5%) was immersed in an aqueous solution which contained caustic soda at an amount of 45–60% by weight based on the total weight of the triacetate fibers, followed by conducting the treatment procedure of Preparation Example I. The detailed amounts of caustic soda used in the saponification and the resulting weight loss percentages are given in Table 3, below. As seen in the data, the triacetate fibers experienced a weight loss of 35–43%.

Their structural changes were examined by the same IR spectroscopic analysis as in Preparation Example I. An examination was also made of the physical properties of the fibers in the same manner as in Preparation Example I. The physical property results are summarized in Table 4, below. Sample B-1, which did not experience the saponification treatment, shows physical properties characteristic to cellulose triacetate. On the other hand, a gradual increase in breaking strength and a closer approach to a rayon fiber in gravity, orientation degree, moisture regain, and dyeing property with a direct dye were detected going from sample B-2 which showed a weight loss of 36.1% (combined acetic acid 13.7%) to sample B-5 which was completely deacetylated. Also, X-ray diffraction spectral data show that the completely deacetylated sample B-5 has a composite crystalline structure of cellulose II and IV. The sample B-5 was as high as 40% in crystallinity.

TABLE 3

| Samples | Saponification Conditions & Weight Loss of Cellulose Diacetate Fibers | |
|---|---|---|
| | Amount of NaOH (%) | Weight Loss (%) |
| B-1 | 0 | 0 |
| B-2 | 45.0 | 36.1 |
| B-3 | 51.2 | 38.4 |
| B-4 | 56.2 | 41.6 |
| B-5 | 60.0 | 43.1 |

TABLE 4

| Samples | Physical Properties of Cellulose Diacetate Fibers | | | | | |
|---|---|---|---|---|---|---|
| | De | Breaking Strength (gf/de) | Breaking Elong. (%) | Specific Gravity (gm/cm$^3$) | Δ n (×10$^3$) | K/S Values |
| B-1 | 75.1 | 0.80 | 34.2 | 1.3100 | 26.9 | 0.01 |
| B-2 | 58.2 | 1.40 | 35.1 | 1.4942 | 13.2 | 9.42 |

TABLE 4-continued

| Samples | Physical Properties of Cellulose Diacetate Fibers | | | | | |
|---|---|---|---|---|---|---|
| | De | Breaking Strength (gf/de) | Breaking Elong. (%) | Specific Gravity (gm/cm$^3$) | Δ n (×10$^3$) | K/S Values |
| B-3 | 54.3 | 1.62 | 34.5 | 1.4945 | 15.2 | 10.83 |
| B-4 | 52.1 | 1.98 | 33.4 | 1.4949 | 16.7 | 11.46 |
| B-5 | 52.4 | 2.40 | 31.2 | 1.5076 | 19.2 | 12.41 |

PREPARATION EXAMPLE III

75 D/24 F diacetate fibers with a degree of substitution of 2.55 (combined acetic acid 56.9%) and polyester SD 75 d/36 f false twisted fibers were combined by air entanglement, after which the combined fibers were twisted at 1,000 T/M. Twill fabrics (warp density 136 picks/inch, weft density 103 picks/inch) comprising the combined, twisted fibers as warps and diacetate fibers (150d/33f, 1,000 T/) as wefts were scoured and dried in an ordinary process. An aqueous solution containing soda ash at an amount of 10–30% by weight based on the total weight of the diacetate fiber was poured into a dyeing machine, and the scoured fabric was immersed. The dyeing bath was heated at a rate of 2° C./min from 30° C. to 98° C., then treated for 30 min at the highest temperature, and then cooled down to 30° C. at a rate of 2° C./min, followed by the drainage of the aqueous solution. In the dyeing machine, the fibers were washed with fresh water to complete the primary process of weight reduction. A small amount of the fabric was taken, dried in a drier maintained at 120° C., and weighed. Next, after being immersed in an aqueous solution containing caustic soda at an amount of 10–40% by weight based on the total weight of the primarily weight-reduced fabric, the primarily weight-reduced fabric was subjected to secondary weight reduction process by treatment at 98° C. for 30 min, washed at room temperature with water to remove residual alkali, and then dried.

To calculate the weight loss in the acetate fiber portion, the fabrics were measured for dry weight before and after the treatment and resolved in acetone. Then, the polyester portion, which remained unresolved, was measured for dry weight.

Along with the saponification conditions, the weight loss percentages of the acetate fibers are given in Table 5 below, while the physical properties of the fibers obtained in this example are summarized in Table 6 below. As recognized from the data of Tables 5 and 6, greater breaking strengths were obtained in samples C-2 to C-4 which were saponified twice primarily by soda ash and secondarily by caustic soda than in sample C-1 which was saponified once with caustic soda. Also, the larger the amount of the primary soda ash was in the primary process, the greater the breaking strength of the fiber was. A similarity was found between the sample fibers and a rayon fiber in terms of gravity, degree of orientation, crystallinity and dyeing property with a direct dye. As in Preparation Example I, an X-ray diffraction diagram demonstrates a composite crystalline structure of cellulose II and IV in the fibers.

TABLE 5

| | Saponification Conditions & Weight Loss | | |
|---|---|---|---|
| Samples | 1st Saponification | 2nd Saponification | Weight Loss (%) |
| C-1 | — | NaOH 40% | 40.1 |
| C-2 | soda ash 10% | NaOH 30% | 41.4 |
| C-3 | Soda ash 20% | NaOH 20% | 41.0 |
| C-4 | soda ash 30% | NaOH 10% | 40.9 |

TABLE 6

| | Physical Properties of Cellulose Diacetate Fibers | | | | | |
|---|---|---|---|---|---|---|
| Samples | De | Breaking Strength (gf/de) | Breaking Elong. (%) | Specific Gravity (gm/cm$^3$) | Δ n (×10$^3$) | K/S Values |
| C-1 | 106.2 | 1.50 | 50.2 | 1.4952 | 33.10 | 15.0 |
| C-2 | 106.5 | 2.40 | 37.8 | 1.4999 | 35.70 | 12.7 |
| C-3 | 105.1 | 2.05 | 40.5 | 1.4951 | 33.05 | 13.4 |
| C-4 | 104.8 | 1.78 | 45.6 | 1.4949 | 32.91 | 13.6 |

PREPARATION EXAMPLE IV

Plain fabrics (warp 75 d/20 d, weft 120 d/33 f, weft density 75 picks/inch) consisting of diacetate fibers with a degree of substitution of 2.55 (combined acetic acid 56.9%) were scoured and dried. Separately, aqueous solutions containing caustic soda at an amount of 40% by weight based on the weight of the diacetate fiber were respectively added with one of the following saponification accelerators at a concentration of 2 g/l: NEORATE NCB (a phosphonium compound, Korea Fine Chemicals Co. Ltd.); KF NEORATE NA-40 (Korea Fine Co. Ltd.), DYK-1125 and DXY-10N (Iposya), CASERIN PES, CASERIN PEL and CASERIN PEF (Meisei Kagaku Co. Ltd.), SNOGEN PDS(Daeyoung Chemicals Co. Ltd.), all of which are quaternary ammonium salts. In the eight aqueous caustic soda solutions thus obtained, the scoured and dried diacetate fibers were immersed, followed by repeating the same procedure as in Preparation Example I. The diacetate fibers were found to be reduced in weight to the weight loss of 40–42%. Along with the saponification conditions, the weight loss percentages of the acetate fibers are given in Table 7 below. Structural changes in the fibers were determined through IR spectra as in Preparation Example I. Their physical properties were also evaluated and are summarized in Table 8 below. As recognized from the data in Table 8, greater breaking strengths were obtained in samples D-2 to D-9, which were treated with saponification accelerator-supplemented caustic soda solutions, than in sample D-1 which was treated with caustic soda alone. A similarity was found between the sample fibers and a rayon fiber in terms of gravity, orientation degree, crystallinity and dyeing property with a direct dye. As in Preparation Example I, an X-ray diffraction diagram demonstrates a composite crystalline structure of cellulose II and IV in the fibers.

TABLE 7

| | Saponification Conditions & Weight Loss of Cellulose Diacetate Fibers | |
|---|---|---|
| Samples | Amount of NaOH (%) | Weight Loss (%) |
| D-1 | NaOH 40% | 40.1 |
| D-2 | NaOH 40% + Neorate NCB 2 g/l | 41.2 |
| D-3 | NaOH 40% + Neorate NA-40 2 g/l | 41.0 |
| D-4 | NaOH 40% + DYK-1125 2 g/l | 40.9 |
| D-5 | NaOH 40% + DXY-10N 2 g/l | 41.2 |
| D-6 | NaOH 40% + CASERIN PES 2 g/l | 41.1 |
| D-7 | NaOH 40% + CASERIN PEL 2 g/l | 40.8 |
| D-8 | NaOH 40% + CASERIN PEF 2 g/l | 40.7 |
| D-9 | NaOH 40% + Snogen PDS 2 g/l | 41.3 |

TABLE 8

| Samples | De | Breaking Strength (gf/de) | Breaking Elong. (%) | Specific Gravity (gm/cm$^3$) | Crystal-linity (%) | Δ n (×10$^3$) |
|---|---|---|---|---|---|---|
| | Physical Properties of Cellulose Diacetate Fibers | | | | | |
| D-1 | 52.9 | 1.50 | 36.4 | 1.4952 | 33.10 | 14.0 |
| D-2 | 52.2 | 1.65 | 35.2 | 1.4997 | 35.59 | 14.2 |
| D-3 | 52.5 | 1.69 | 35.0 | 1.4995 | 35.49 | 13.9 |
| D-4 | 52.8 | 1.75 | 36.2 | 1.4996 | 35.53 | 14.1 |
| D-5 | 52.1 | 1.73 | 36.1 | 1.4998 | 35.64 | 13.4 |
| D-6 | 52.7 | 1.52 | 36.2 | 1.4997 | 35.59 | 12.8 |
| D-7 | 52.9 | 1.51 | 35.0 | 1.4994 | 35.41 | 14.3 |
| D-8 | 52.5 | 1.59 | 35.4 | 1.4992 | 35.31 | 12.9 |
| D-9 | 52.4 | 1.82 | 35.8 | 1.4999 | 35.70 | 13.5 |

As described hereinbefore, the rayon fiber of the present invention has a composite crystalline structure of cellulose II and IV and possesses characteristics similar to those of a viscose rayon fiber as to be suitable for use in clothes. Also, the method according to the present invention is simple and produces the rayon fiber at low cost without producing pollution of the environment.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced other than as specifically described.

What is claimed is:

1. A method for preparing a rayon fiber, comprising the step of treating a cellulose acetate fiber with an alkali to saponify at least 75% of the total acetyl groups of the cellulose acetate fiber into hydroxyl groups, whereby the rayon fiber has a composite crystalline structure of cellulose II and IV.

2. The method as set forth in claim 1 wherein the alkali is a strong alkali.

3. The method as set forth in claim 1 wherein the cellulose acetate fiber is treated with a strong and a weak alkali in the same bath.

4. The method as set forth in claim 1 wherein the cellulose acetate fiber is treated with a strong alkali and a weak alkali in different baths.

5. The method as set forth in claim 1 wherein the celluose acetate fiber is selected from the group consisting of a cellulose diacetate fiber with a degree of substitution ranging from 2.0–2.75, a cellulose triacetate fiber with a degree of substitution of at least 2.75, and a mixture thereof.

6. The method as set forth in claim 1 wherein the alkali is supplemented with a saponification accelerator selected from the group consisting of a quaternary ammonium salt and a phosphonium salt.

7. A method for preparing a rayon fiber, comprising the step of treating a fiber material comprising cellulose acetate fibers with an alkali to saponify 75% or greater of the total acetyl groups of the cellulose acetate fibers into hydroxyl groups, said fiber material being selected from the group consisting of a woven fabric, a knitted fabric, and a non-woven fabric, whereby the rayon fiber has a composite crystalline structure of cellulose II and IV.

8. The method according to claim 7 wherein the cellulose acetate fibers are treated in combination with other fibers.

9. The method according to claim 7 wherein said fiber material is made by weaving, knitting or punching cellulose acetate fibers alone or in combination with other fibers.

10. The method as set forth in claim 8 wherein the alkali is a strong alkali.

11. The method as set forth in claim 8 wherein the cellulose acetate fiber is treated with a strong and a weak alkali in the same bath.

12. The method as set forth in claim 8 wherein the cellulose acetate fiber is treated with a strong alkali and a weak alkali in different baths.

13. The method as set forth in claim 7 wherein the cellulose acetate fiber is selected from the group consisting of a cellulose diacetate fiber with a degree of substitution ranging from 2.0–2.75, a cellulose triacetate fiber with a degree of substitution at least of 2.75, and a mixture thereof.

14. The method as set forth in claim 7 wherein the alkali is supplemented with a saponification accelerator selected from the group consisting of a quaternary ammonium salt and a phosphonium salt.

15. A rayon fiber product, comprising a rayon fiber which possesses a composite crystalline structure of cellulose II and IV and is prepared by saponifying at least 75% of the total acetyl groups of a cellulose acetate fiber with a degree of substitution of at least 2.0 into hydroxyl groups.

16. A method for producing a rayon fiber product, comprising the step of treating a fiber material comprising cellulose acetate fibers with an alkali to saponify at least 75% of the total acetyl groups of the cellulose acetate fibers into hydroxyl groups, said fiber material being selected from the group consisting of a woven fabric, a knitted fabric, and a non-woven fabric, said cellulose acetate fibers having a degree of substitution of at least 2.0, whereby the rayon fiber product has a composite crystalline structure of cellulose II and IV.

17. The method according to claim 16 wherein the cellulose acetate fibers are treated in combination with other fibers.

18. The method according to claim 16 wherein said fiber material is made by weaving, knitting or punching cellulose acetate fibers alone or in combination with other fibers.

19. The method as set forth in claim 17 wherein the alkali is a strong alkali.

20. The method as set forth in claim 17 wherein the cellulose acetate fiber is treated with a strong and a weak alkali in the same bath.

21. The method as set forth in claim 17 wherein the cellulose acetate fiber is treated with a strong alkali and a weak alkali in different baths.

22. The method as set forth in claim 16 wherein the cellulose acetate fiber is selected from the group consisting of a cellulose diacetate fiber with a degree of substitution ranging from 2.0–2.75, a cellulose triacetate fiber with a degree of substitution of at least 2.75, and a mixture thereof.

23. The method as set forth in claim 16 wherein the alkali is supplemented with a saponification accelerator selected from a group consisting of quaternary ammonium salt and a phosphonium salt.

24. A rayon film, which is prepared from a cellulose acetate film with a degree of substitution of at least 2.0 by saponifying at least 75% of the total acetyl groups of the film into hydroxyl groups and possesses a composite crystalline structure of cellulose II and IV.

25. A method for producing a rayon film, comprising the step of treating a cellulose acetate film with an alkali to saponify at least 75% of the total acetyl groups of the cellulose acetate film into hydroxyl groups, whereby the rayon film has a composite crystalline structure of cellulose II and IV.

26. The method as set forth in claim 25 wherein the alkali is a strong alkali.

27. The method as set forth in claim 25 wherein the cellulose acetate fiber is treated with a strong and a weak alkali in the same bath.

28. The method as set forth in claim 25 wherein the cellulose acetate film is treated with a strong alkali and a weak alkali in different baths.

29. The method as set forth in claim 25 wherein said cellulose acetate film is selected from the group consisting of a cellulose diacetate film with a degree of substitution ranges from 2.0–2.75, a cellulose triacetate film with a degree of substitution of at least 2.75, and a mixture thereof.

30. The method as set forth in claim 25 wherein the alkali is supplemented with a saponification accelerator selected from the group consisting of a quaternary ammonium salt and a phosphonium salt.

* * * * *